US005141393A

United States Patent [19]

Marra

[11] Patent Number: 5,141,393

[45] Date of Patent: Aug. 25, 1992

[54] SEAL ACCOMMODATING THERMAL EXPANSION BETWEEN ADJACENT CASINGS IN GAS TURBINE ENGINE

[75] Inventor: John J. Marra, Jupiter, Fla.

[73] Assignee: United Technologies Corporation, Hartford, Conn.

[21] Appl. No.: 753,542

[22] Filed: Sep. 3, 1991

[51] Int. Cl.[5] ..... F01D 25/26

[52] U.S. Cl. ..... 415/138; 415/170.1; 415/214.1; 277/12; 277/237 R; 285/187; 285/320; 285/363; 403/28; 403/161

[58] Field of Search ..... 415/134, 138, 139, 170.1, 415/214.1; 277/12, 237 R; 285/24, 187, 320, 363, 412; 403/28, 161

[56] References Cited

U.S. PATENT DOCUMENTS

| | | | |
|---|---|---|---|
| 2,638,743 | 5/1953 | Feilden | 415/134 |
| 3,698,743 | 10/1972 | Sweet et al. | 285/187 |
| 3,853,336 | 12/1974 | Shank | 285/187 |
| 4,098,476 | 7/1978 | Jutte et al. | 285/187 |
| 4,184,689 | 1/1980 | Brodell et al. . | |
| 4,696,619 | 9/1987 | Lardellier | 415/138 |
| 4,921,680 | 5/1990 | Bonk et al. . | |
| 5,088,775 | 2/1992 | Corsmeier et al. | 285/24 |

*Primary Examiner*—Edward K. Look
*Assistant Examiner*—Christopher M. Verdier
*Attorney, Agent, or Firm*—Edward L. Kochey, Jr.

[57] ABSTRACT

A casing around a turbine and a casing around discharge nozzles have a concentrically arranged shell portion. The seal contains internal pressure while accommodating eccentric, expansion and axial travel. Arcuate seal segments have one leg sealing against a radial surface extending from the inner shell and the other leg against the outer shell. A linkage guides travel of the segments.

10 Claims, 5 Drawing Sheets

SEAL ACCOMMODATING THERMAL EXPANSION BETWEEN ADJACENT CASINGS IN GAS TURBINE ENGINE

The inventions described herein was made in the performance of work under NASA contract and is subject to the provisions of Section 305 of the National Aeronautics and Space Acts of 1958 (72 Stat. 435; 42 U.S.C. 2457).

TECHNICAL FIELD

The invention relates to gas seals and in particular to seals between non-rotating members in a gas turbine engine which experience relative displacement.

BACKGROUND OF THE INVENTION

A gas turbine engine as used in an aircraft requires a compressor, a gas turbine and an exhaust duct. The exhaust duct includes discharge nozzles which may be controlled for thrust direction.

All the forces placed on the engine must be transmitted to the airframe. The thrust controlling nozzles place loads similar to, and in the same general location as airframe empennage loads. It is therefore advantageous to integrate the nozzle structural members with the airframe structural members, so as to eliminate the need for redundant structures, with the attendant weights savings. To obtain maximum benefit, these combined loads must be divorced from the loads generated by the gas turbine itself If this is not done, these vectoring and engine loads become statically indeterminate, and introduce bending into the engine, which is detrimental to engine life and performance, negating any weight savings due to integrated structure. Differential expansion, both radially and axially, must be accepted and differential movement, including eccentric movement, must be tolerated between the nozzle structure and the upstream structure. The gas pressure in the order of 3 to 4 atmospheres must also be sealed between the gas turbine exhaust and the nozzle.

Attempts to permit this movement with appropriate sealing using bellows have been a problem because of a structural instability known as squirming, which occurs when a bellows is made sufficiently thin to avoid transferring loads between the nozzle and engine It is desirable to seal such moderate pressures with minimal leakage between the components where relative displacements of up to 4 centimeters in any direction are anticipated.

SUMMARY OF THE INVENTION

The gas turbine engine has an upstream casing surrounding the compressor and turbine as well as a downstream casing operating as an exhaust duct to convey the gases to the discharge nozzle. These two casings are to be independently supported and therefore experience relative movement.

The downstream casing has a cylindrical extension which is coextensive with and concentrically surrounding a cylindrical portion of the upstream casing. At this coextensive location there is thereby formed an outer shell and an inner shell with an annular space between these shells. The annular space is exposed on one side to the pressure inside the upstream and downstream casings, more particularly the gas pressure upstream of the exhaust nozzle. On the second side the annular space is exposed to external or ambient pressure. It is at this location where the gas seal is required to achieve minimum leakage while permitting relative movement of the two components.

A circumferential radially extending seal surface extends from the inner shell toward the outer shell with the surface facing toward the internal pressure side. A plurality of arcuate seal segments are circumferentially arranged within this annular space. Each seal segment includes and L-shaped section with one leg in sealing contact with the radially extending seal surface, and the other leg in sealing contact with the internal surface of the outer shell. Locating means secure each seal segment loosely adjacent to the seal surface, with the internal pressure pressing the segments into contact to achieve the sealing.

The locating means comprises a plurality of links secured to the inner shell with the links extending at an angle with respect to the radial direction. They are pinned both to the inner shell and to the segments.

DESCRIPTION OF THE PREFERRED EMBODIMENT

Figure 1:
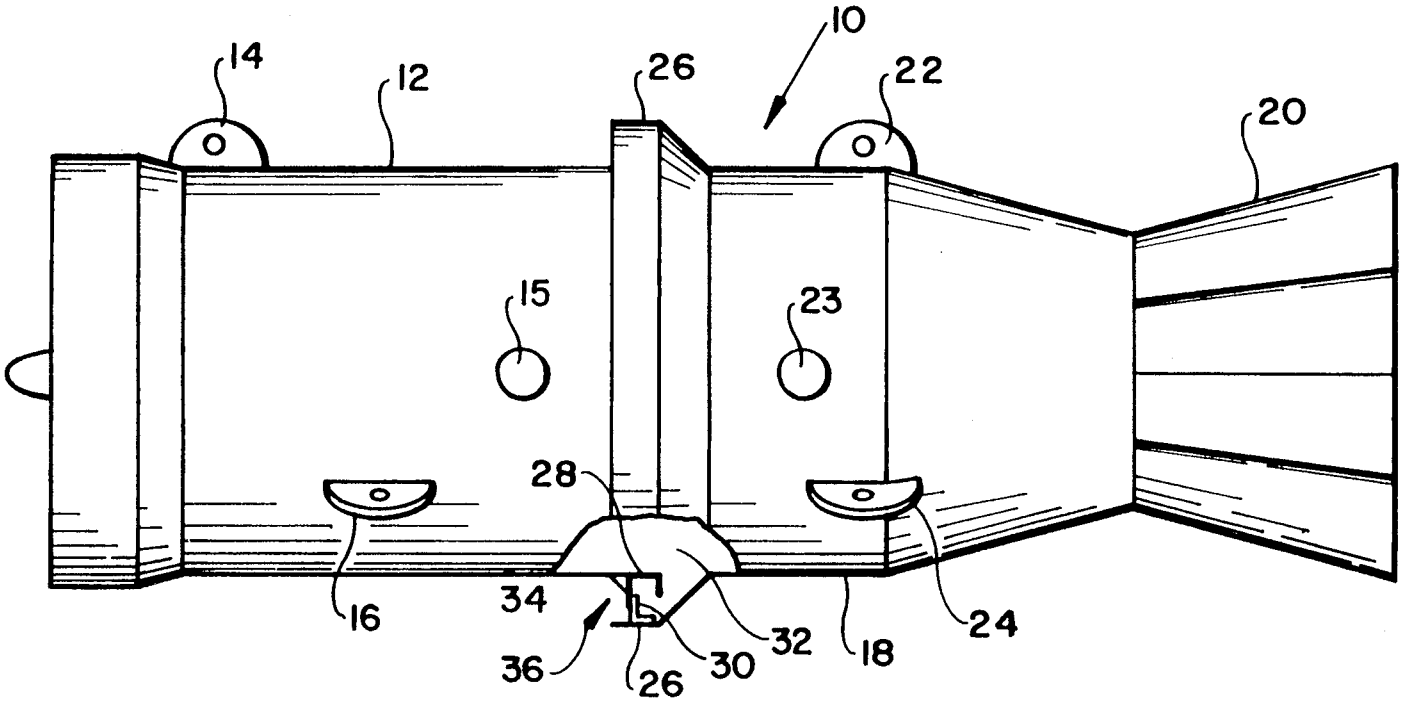
FIG. 1 is a schematic view of the engine, nozzle, and support locations.

Gas turbine engine 10 has an upstream casing 12 supported generally on supports 14, 15, and 16. The downstream casing 18 includes exhaust nozzle 20 and is supported generally at support locations 22, 23, and 24.

The downstream casing has a cylindrical extension 26 coextensive with and surrounding a cylindrical portion 28 of the upstream casing. The extension 26 is designated as outer shell 26 which surrounds shell 28 forming an annular space 30 between the shells. This space is exposed on one side to internal pressure 32 while the other side is exposed to the external ambient pressure 34. Seal 36 is located in this annular space.

Figure 2:
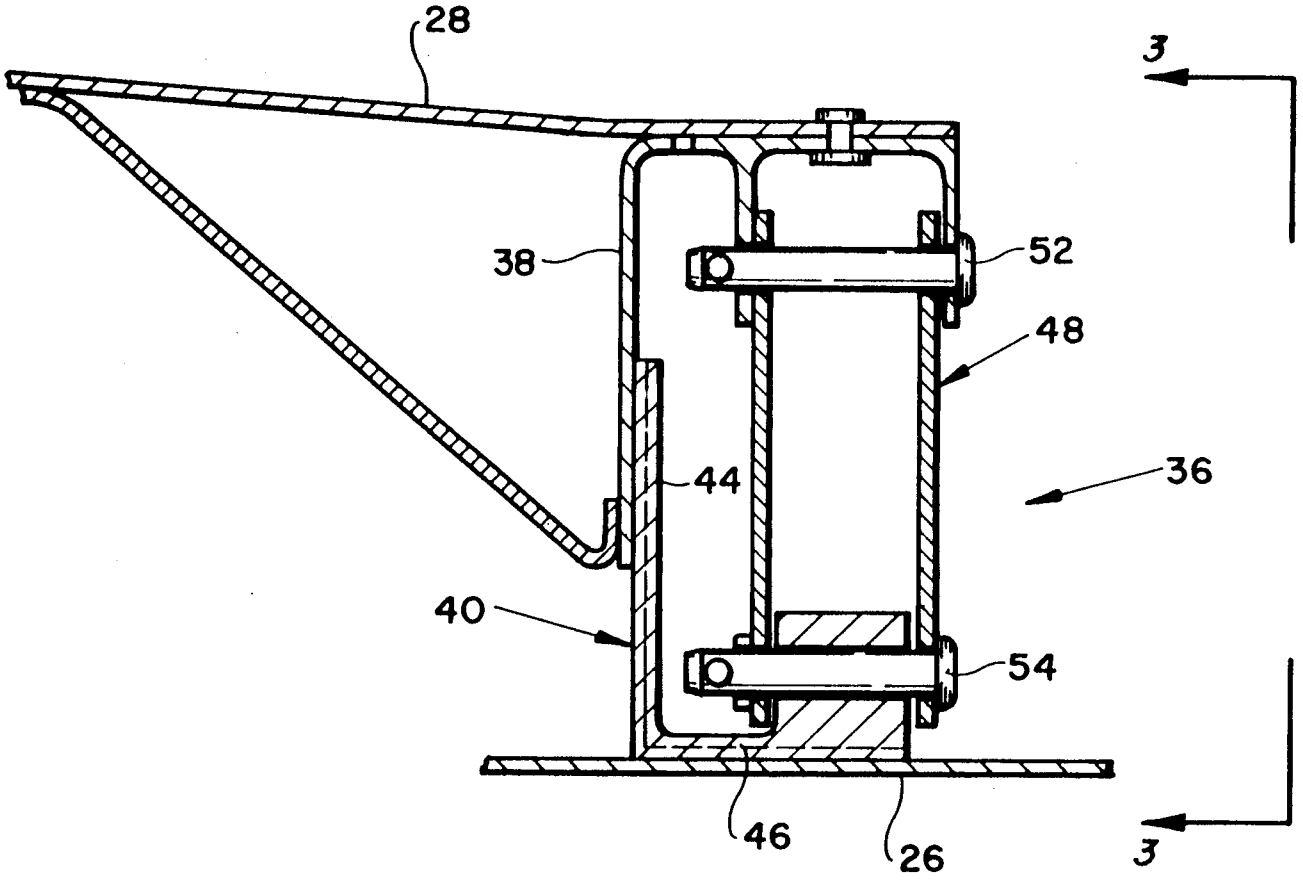
FIG. 2 is a section through the seal.

Referring to FIG. 2, a circumferential radially extending seal surface 38 is secured to the inner shell 28. The seal surface faces toward the internal pressure side. A plurality of arcuate seal segments 40 are circumferentially arranged within the annular space. Each seal segment includes an L-shaped section with one leg 44 in sealing contact with the radially extending seal surface 38. The other leg 46 is in sealing contact with the outer shell 26.

Figure 3:
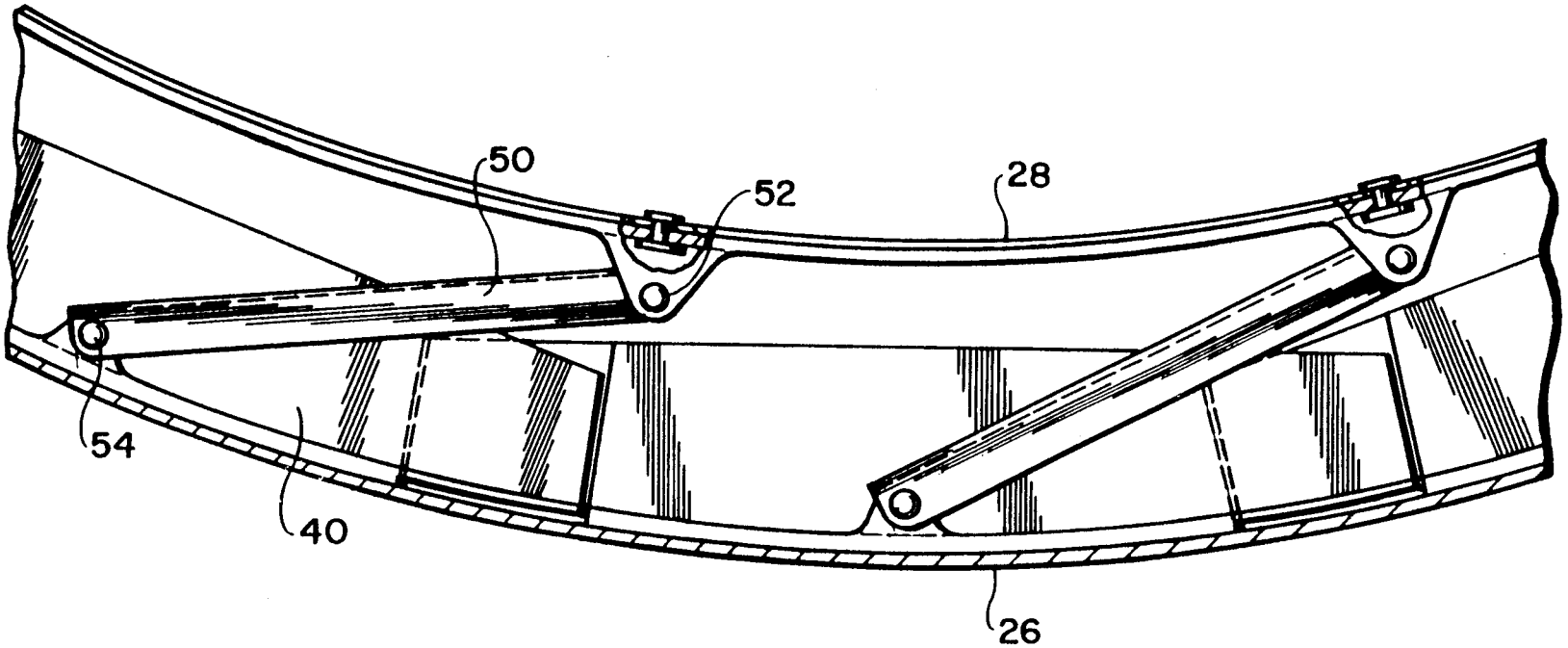
FIG. 3 is a side view of the seal.

Locating means 48 functions to keep the seal segments 40 loosely adjacent the seal surface 38. Referring also to FIG. 3, a link 50 for each seal segment is connected to the inner shell by a pin connection 52. It is connected to each seal segment 40 by pin connection 54. These links extend at an angle with respect to the radial direction, this angle being in the same clockwise direction for each link.

Should the inner shell expand with respect to the outer shell the links will pivot, and as viewed in FIG. 3, the seal segments shift to the left in a clockwise direction. Should the inner shell move eccentrically down as shown in FIG. 3, the lower segments seen in FIG. 3 will move in a clockwise direction while the segments at the top would move in a counter-clockwise direction. Sufficient clearance between the segments must be established to permit this potential differential movement of the various segments.

Figure 4:
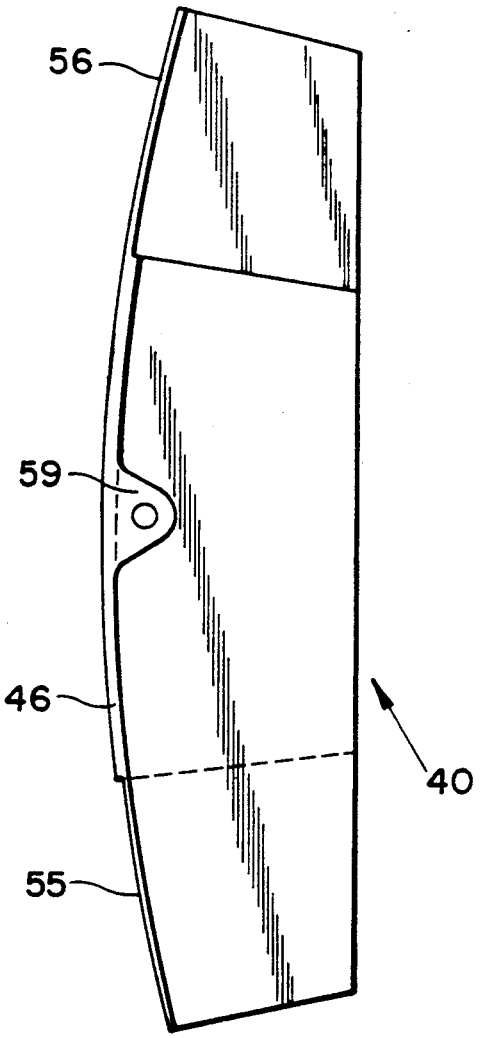
FIGS. 4 and 5 are views of the seal segments.
Figure 5:
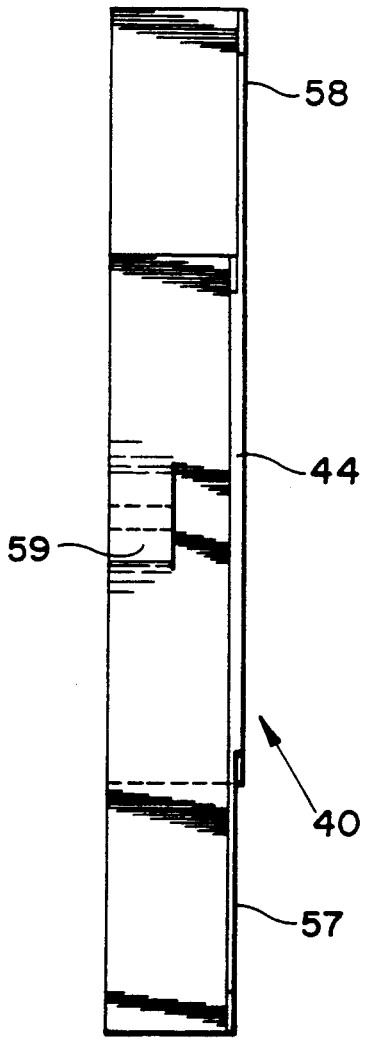

FIGS. 4 and 5 illustrate one of the segments in detail. It can be seen that leg 46 is arcuately shaped to fit against the internal surface of shell 26 including however, a recess 55 suitable for accepting a reduced thickness portion 56 of an adjacent segment. In a similar manner, leg 44 has a recess 57 and a corresponding reduced thickness portion 58 at the other end sized to fit within recess 57. Bracket 59 is a portion of the pin connection 54. The reduced thickness portions 56 and 58 are sized with respect to the recesses 55 and 57 to substantially fill the recess except for the clearance at the end required for differential movement in the closing direction. Only minor leakage at the ends of this interface will occur.

Figure 6:
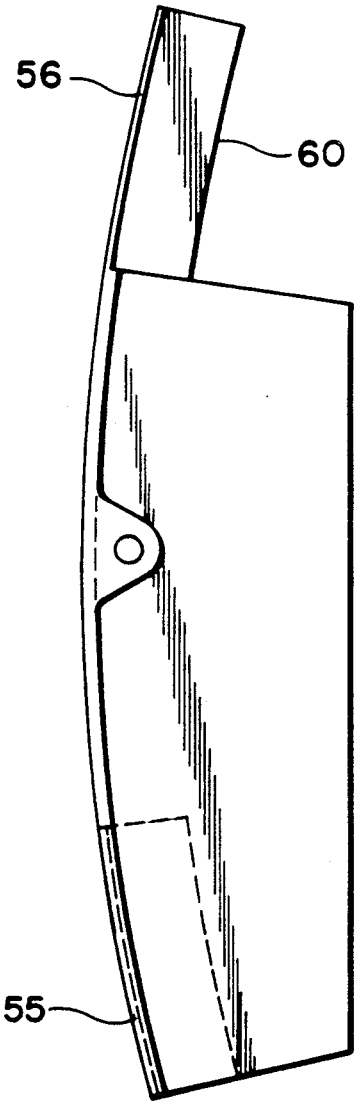
FIGS. 6 and 7 are views of alternate seal segments.
Figure 7:
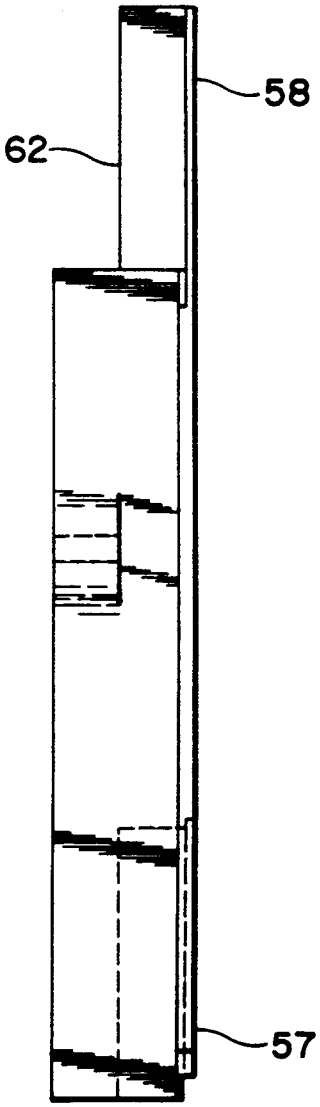

FIGS. 6 and 7 illustrate a modification of the seal segments to further minimize leakage. End portions 56 and 58 are not only truncated in thickness but is also truncated in height and width. Recesses 55 and 57 are similarly reduced in height and width to snugly accept the portions 56 and 58. In this manner a seal is effected along surfaces 60 and 62 of the installed segments, thereby further reducing seal leakage.

The seal arrangement accommodates substantial eccentricity, as well as axial travel and differential expansion.

I claim:

1. In a gas turbine engine having an upstream casing and a downstream casing the improvement comprising:

one of said upstream and downstream casings having a cylindrical extension coextensive with and concentrically surrounding a cylindrical portion of the other of said upstream and downstream casings, whereby at the coextensive location there is formed an outer shell, an inner shell and an annular space between said outer shell and said inner shell, said annular space exposed from one side to pressure inside said upstream and downstream casings, and on the second side to external pressure;

a circumferential radially extending seal surface extending from one shell of said inner and outer shells toward the other shell of said inner and outer shells, said surface axially facing toward said internal pressure side;

a plurality of arcuate seal segments circumferentially arranged within said annular space;

each seal segment including an L-shaped section with one leg in sealing contact with said radially extending seal surface and the other leg in sealing contact with said other shell; and locating means for securing each seal segment to said one shell loosely adjacent said seal surface.

2. A gas turbine engine as in claim 1:

the outer edges of each seal segment overlapping the edges of each adjacent seal segment.

3. A gas turbine engine as in claim 2:

said locating means for each segment comprising a link, a pin connection between said link and said one shell, and a pin connection between said link and said seal segment.

4. A gas turbine engine as in claim 3, comprising also:

said links extending at an angle with respect to the radial direction, and the angle of each link with respect to the radial direction being in the same clockwise direction.

5. A gas turbine engine as in claim 2, each segment including:

a truncated L-shaped portion at one end of said segment of a height, width and thickness less than the balance of said segment; and a corresponding recess at the other end of each segment sized to receive one of said truncated portions.

6. A gas turbine engine as in claim 1, wherein:

said one shell comprises said inner shell; and said other shell comprises said outer shell.

7. A gas turbine engine as in claim 6:

the outer edges of each seal segment overlapping the edges of each adjacent seal segment.

8. A gas turbine engine as in claim 7:

said locating means for each segment comprising a link, a pin connection between said link and said one shell, and a pin connection between said link and said seal segment.

9. A gas turbine engine as in claim 8, comprising also:

said links extending at an angle with respect to the radial direction, and the angle of each link with respect to the radial direction being in the same clockwise direction.

10. A gas turbine engine as in claim 7, each segment including:

a truncated L-shaped portion at one end of said segment of a height, width and thickness less than the balance of said segment; and a corresponding recess at the other end of each segment sized to receive one of said truncated portions.

* * * * *